US011787654B2

(12) United States Patent
Kobayashi

(10) Patent No.: US 11,787,654 B2
(45) Date of Patent: Oct. 17, 2023

(54) SHEET FEEDING APPARATUS AND PRINTING APPARATUS

(71) Applicant: CANON KABUSHIKI KAISHA, Tokyo (JP)

(72) Inventor: Ryo Kobayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 240 days.

(21) Appl. No.: 17/162,121

(22) Filed: Jan. 29, 2021

(65) Prior Publication Data

US 2021/0237998 A1 Aug. 5, 2021

(30) Foreign Application Priority Data

Feb. 4, 2020 (JP) ..... 2020-017234

(51) Int. Cl.

| | |
|---|---|
| ***B65H 16/10*** | (2006.01) |
| ***B65H 20/36*** | (2006.01) |
| ***B65H 20/02*** | (2006.01) |
| ***B65H 26/06*** | (2006.01) |
| ***B65H 19/10*** | (2006.01) |

(52) U.S. Cl.

CPC ..... *B65H 16/103* (2013.01); *B65H 19/105* (2013.01); *B65H 20/02* (2013.01); *B65H 20/36* (2013.01); *B65H 26/06* (2013.01); *B65H 2301/4151* (2013.01); *B65H 2301/522* (2013.01); *B65H 2403/942* (2013.01); *B65H 2801/21* (2013.01)

(58) Field of Classification Search

None

See application file for complete search history.

(56) References Cited

U.S. PATENT DOCUMENTS

| | | | | |
|---|---|---|---|---|
| 5,179,390 | A * | 1/1993 | Yokoyama | B41J 17/06 346/136 |
| 5,533,821 | A * | 7/1996 | Awai | B41J 15/042 400/621 |
| 8,599,229 | B1 * | 12/2013 | Mindler | B41J 15/04 347/218 |
| 9,592,683 | B2 | 3/2017 | Kobayashi et al. | |
| 9,969,192 | B2 | 5/2018 | Suzuki et al. | |
| 10,059,131 | B2 | 8/2018 | Sumioka et al. | |
| 10,421,299 | B2 | 9/2019 | Daikoku et al. | |
| 10,427,431 | B2 | 10/2019 | Masuda et al. | |

(Continued)

FOREIGN PATENT DOCUMENTS

JP 2006-306511 A 11/2006

*Primary Examiner* — William A. Rivera

(74) *Attorney, Agent, or Firm* — Venable LLP

(57) ABSTRACT

A sheet feeding apparatus includes a supporting unit that rotatably supports a roll sheet formed by winding a continuous sheet into a roll shape, a conveying path forming member that is placed in a position spaced apart from the roll sheet supported by the supporting unit, and forms a conveying path of the sheet, and a displacing unit that includes a guide portion capable of being displaced between a guide position and a retracting position set farther from a start position than the guide position. The guide portion is displaced from the retracting position to the guide position when a leading edge of the sheet separated from the roll sheet supported by the supporting unit is positioned between the guide portion in the retracting position and the start position.

20 Claims, 14 Drawing Sheets

(56) References Cited

U.S. PATENT DOCUMENTS

| | | | | |
|---|---|---|---|---|
| 10,597,247 | B2 | 3/2020 | Eiyama et al. | |
| 10,703,117 | B2 | 7/2020 | Eiyama et al. | |
| 10,766,279 | B2 | 9/2020 | Yasuda et al. | |
| 10,829,329 | B2 | 11/2020 | Suzuki et al. | |
| 11,130,648 | B2 * | 9/2021 | Asai | B65H 29/52 |
| 2004/0046312 | A1 * | 3/2004 | Thogersen | B41J 15/04 271/186 |
| 2007/0248396 | A1 * | 10/2007 | Blanchard, Jr. | B65H 23/34 400/621 |
| 2009/0261140 | A1 * | 10/2009 | Kase | B41J 15/005 226/50 |
| 2011/0103869 | A1 * | 5/2011 | Shirotori | B41J 11/70 400/621 |
| 2019/0152240 | A1 * | 5/2019 | Teh | B41J 11/0045 |
| 2020/0198381 | A1 * | 6/2020 | Maeda | B65H 19/12 |
| 2020/0290836 | A1 * | 9/2020 | Takahashi | B65H 23/34 |
| 2022/0355599 | A1 * | 11/2022 | Hirama | B41J 3/4075 |

* cited by examiner

TYPE OF PAPER WITH STRONG CURLING

TYPE OF PAPER WITH WEAK CURLING

SHEET FEEDING APPARATUS AND PRINTING APPARATUS

BACKGROUND OF THE INVENTION

Field of the Invention

The present invention relates to a sheet feeding apparatus and a printing apparatus.

Description of the Related Art

A printing apparatus that pulls out a long printing medium such as roll paper and performs printing is known. When roll paper is set in a printing apparatus like this, it is sometimes necessary to pull out the leading edge of the paper and guide the leading edge to a conveying path. Japanese Patent Laid-Open No. 2006-306511 discloses a technique that brings a flap into contact with rotating roll paper and inserts the flap between the leading edge of the roll paper and the paper surface inside the leading edge, thereby separating the leading edge from the inside paper surface and guiding the leading edge to a conveying path.

SUMMARY OF THE INVENTION

According to one embodiment of the present invention, there is provided a sheet feeding apparatus comprising: a supporting unit configured to rotatably support a roll sheet formed by winding a continuous sheet into a roll shape; a first conveying path forming member placed in a position spaced apart from the roll sheet supported by the supporting unit, and configured to form a first conveying path of the sheet; and a displacing unit including a guide portion capable of being displaced between a guide position on the side of a start position of the first conveying path, and a retracting position set farther from the start position than the guide position, wherein the guide portion is displaced from the retracting position to the guide position when a leading edge of the sheet separated from the roll sheet supported by the supporting unit is positioned between the guide portion in the retracting position and the start position.

Further features of the present invention will become apparent from the following description of exemplary embodiments (with reference to the attached drawings).

DESCRIPTION OF THE EMBODIMENTS

Figure 1:
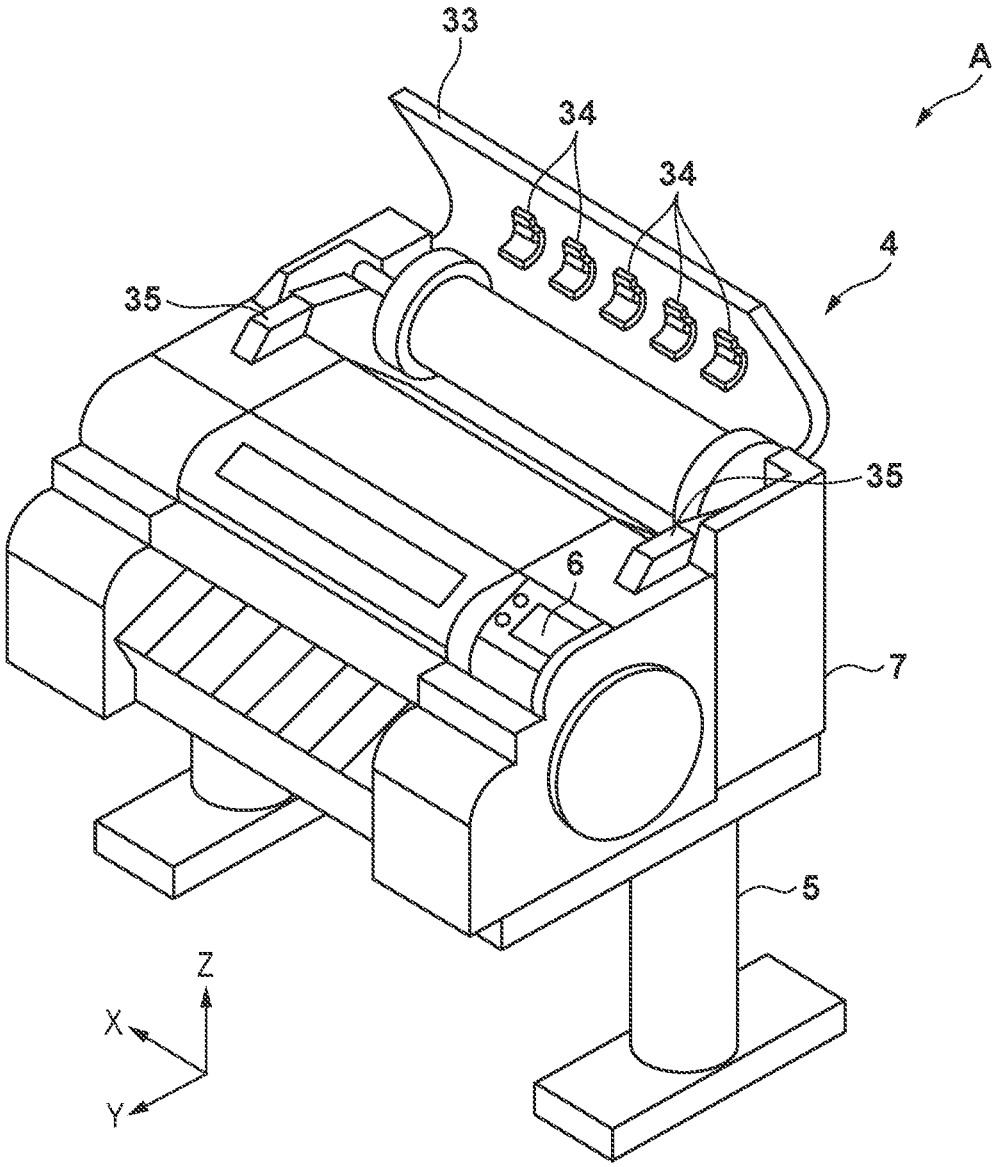
FIG. 1 is a perspective view schematically showing a printing apparatus according to an embodiment.

In the abovementioned related art, however, the flap is in contact with roll paper above the rotational axis of the roll paper, so the influence of gravity acting on the leading edge of the roll paper makes it difficult to form a gap between the leading edge of the roll paper and the paper surface inside the leading edge. Therefore, the flap cannot easily enter between the leading edge of the roll paper and the inside paper surface, so the leading edge of the roll paper is not guided to the conveying path in some cases.

Embodiments of the present invention provide a technique that guides a rolled printing medium to a conveying path more reliably.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

Note that "print" includes not only formation of significant information such as a character or graphic pattern but also formation of an image, design, or pattern on print media in a broader sense or processing of print media regardless of whether the information is significant or insignificant or has become obvious to allow human visual perception. In this embodiment, "print media" are assumed to be paper sheets but may be fabrics, plastic films, and the like.

First Embodiment

<Outline of Printing Apparatus>

FIG. 1 is a perspective view schematically showing a printing apparatus A according to the embodiment. The printing apparatus A pulls out a sheet S as a continuous printing medium from a roll sheet R (to be also referred to as the roll body R hereinafter) obtained by winding the sheet S into the form of a roll, and prints an image on the sheet S. The printing apparatus A includes a main body 4 and legs 5 that support the main body 4. The main body 4 includes a printing unit 1 (see FIG. 2) for printing an image on the sheet S, a sheet feeding unit 3 (see FIG. 2) for feeding a printing medium to the printing unit 1, and a housing 7 for accommodating these units. The main body 4 also includes an operation panel 6 that is formed on the outer surface of the housing 7, accepts inputting of various settings and commands from a user, and displays various kinds of information. For example, the operation panel 6 includes hard keys for accepting inputting from the user, and a display for displaying various kinds of information. The operation panel 6 can also be a touch panel capable of accepting inputting from the user and displaying various kinds of information.

<Outline of Sheet Feeding Unit>

Figure 2:
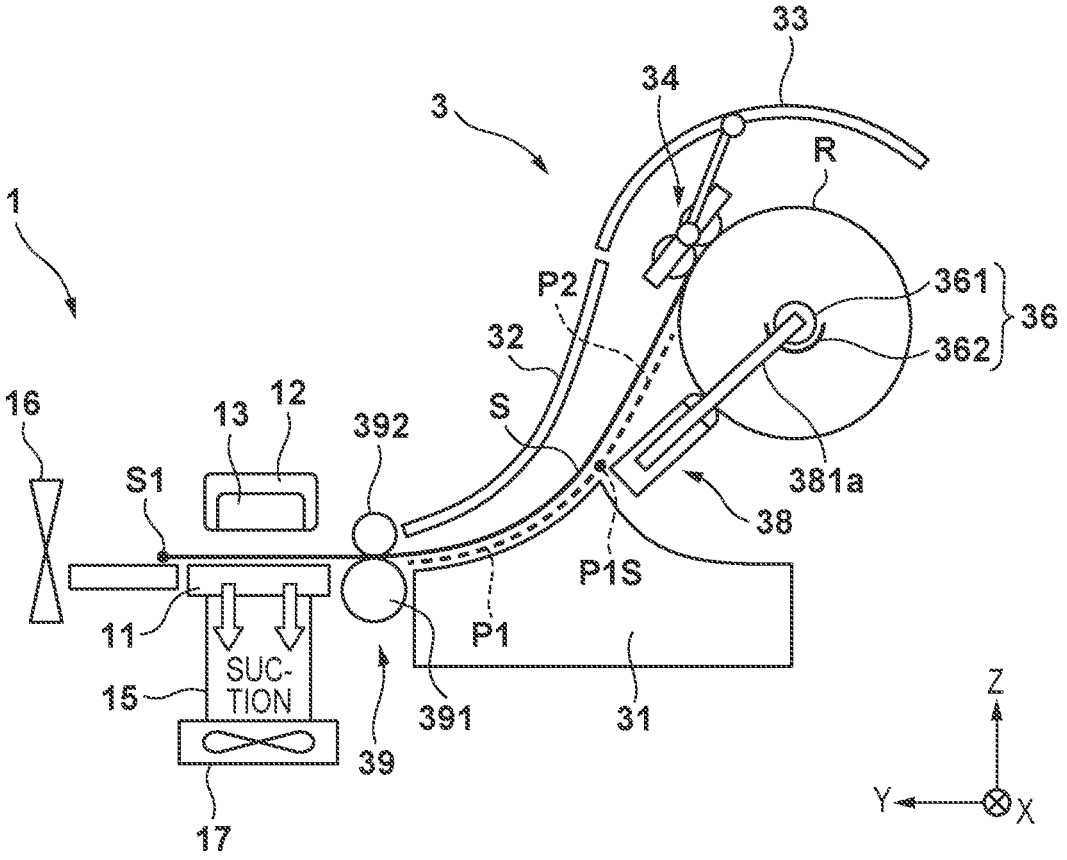
FIG. 2 is a side view showing an outline of a printing unit and a sheet feeding unit.

The explanation will be made with reference to FIG. 2 in addition to FIG. 1. FIG. 2 is a side view showing an outline of the printing unit 1 and the sheet feeding unit 3. Note that FIG. 2 does not show some components such as the housing 7. The sheet feeding unit 3 (a sheet feeding apparatus) feeds the sheet S pulled out from the roll body R to the printing unit 1. In this embodiment, the sheet feeding unit 3 includes a supporting unit 36, a roll drive motor 37 (see FIG. 3), a lower guide 31, and a conveying unit 39.

The supporting unit 36 rotatably supports the roll body R. The roll drive motor 37 rotates the roll body R supported by the supporting unit 36 and feeds the sheet S from the roll body R. The lower guide 31 forms a conveying path P1 for the sheet S fed from the roll body R. The conveying unit 39 conveys the sheet S having passed through the conveying path P1 to the printing unit 1 on a further downstream side. Note that the rest of the arrangement of the sheet feeding unit 3 will be explained in <Details of Sheet Feeding Unit>

<Outline of Printing Unit>

Reference will continuously be made to FIGS. 1 and 2. The printing unit 1 prints an image on the sheet S fed from the sheet feeding unit 3. The printing unit 1 includes a platen 11, a carriage 12, and a printhead 13. That is, the printing unit 1 prints an image by using an inkjet method. However, the printing unit 1 can also print an image by using another method such as an electrophotographic method. The printing unit 1 also includes a duct 15, a cutter 16, and a suction fan 17.

The platen 11 is formed below the carriage 12 and the printhead 13 with the conveyance path of the sheet S being sandwiched between them. The platen 11 has a plurality of intake holes, and is connected to the suction fan 17 via the duct 15. When the suction fan 17 is driven, a suction negative pressure is generated in the duct 15 and the intake holes of the platen 11, so the platen 11 can hold the sheet S by suction.

The carriage 12 has the printhead 13 mounted on it, and is so guided and supported as to be reciprocally movable in ±X directions (main scanning directions) along a carriage shaft (not shown) as a scanning guide extended in the X direction. A plurality of discharge holes (nozzles) for discharging ink are arrayed on the printhead 13, and discharge ink in accordance with image data while the carriage 12 is moving. When an image of one line is printed by the discharging operation of the printhead 13 and the movement of the carriage 12 as described above, the conveying unit 39 of the sheet feeding unit 3 conveys the sheet S at only a predetermined pitch in the conveying direction. Then, the printhead 13 prints an image of the next line while the carriage 12 is moving again. Images are printed on the whole page by repeating this processing. Also, the cutter 16 is installed downstream of the printhead 13 in the conveying direction, and cuts the sheet S for which printing is complete.

<Control Configuration>

Figure 3:
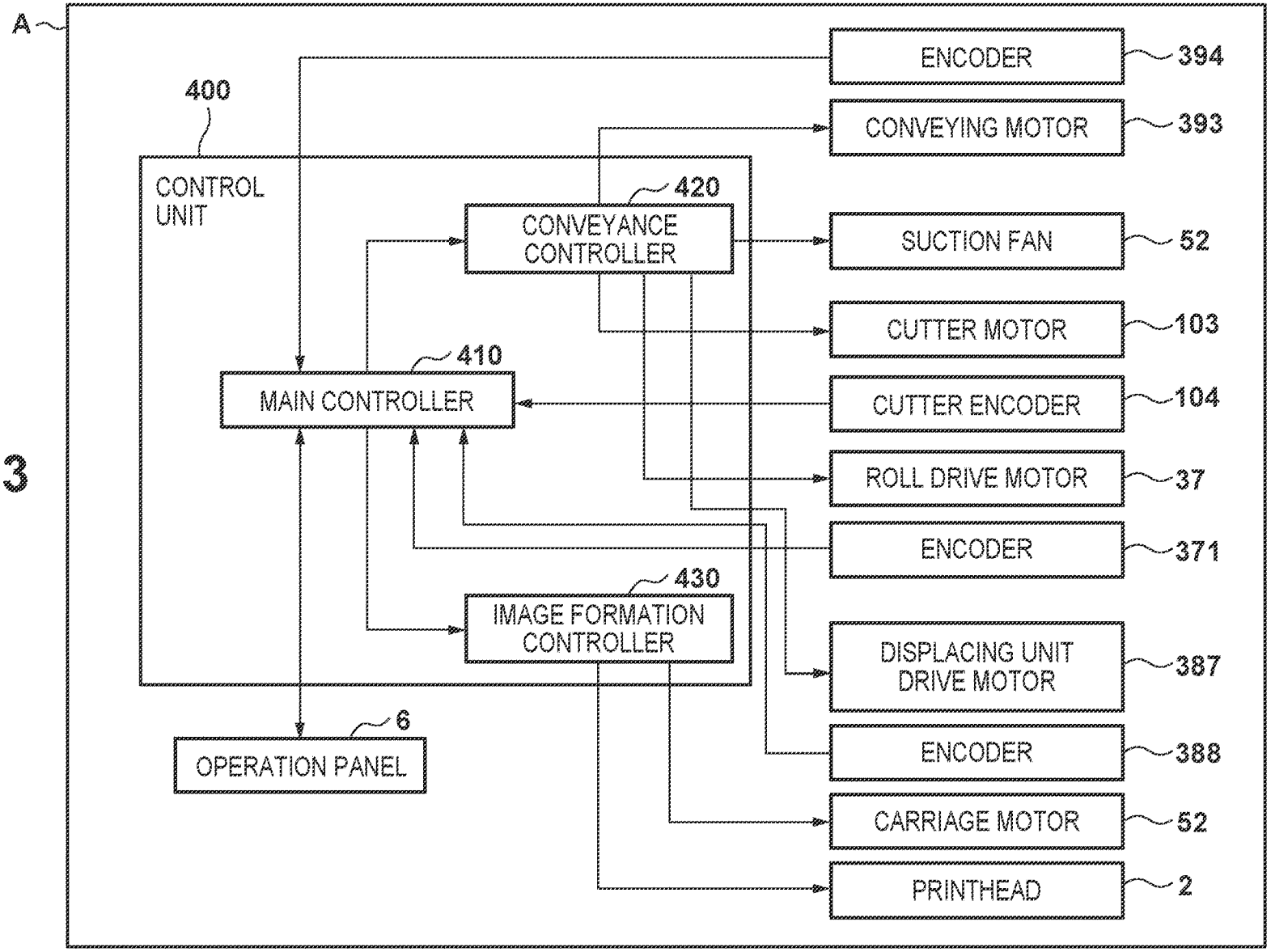
FIG. 3 is a block diagram showing an example of the control configuration of the printing apparatus.

FIG. 3 is a block diagram showing an example of the control configuration of the printing apparatus A according to the embodiment.

A control unit 400 controls the printing apparatus A. The control unit 400 includes, for example, a CPU, a ROM, a RAM, a communication I/F, an input/output I/F, and a motor driver, and implements the functions of a main controller 410, a conveyance controller 420, and an image formation controller 430 by using these components.

The main controller 410 comprehensively controls the printing apparatus A. The main controller 410 gives instructions to the conveyance controller 420 and the image formation controller 430 based on signals from encoders of individual motors and inputting of various kinds of information accepted by the operation panel 6. For example, the main controller 410 performs control based on signals from an encoder 394 of a conveying motor 393, an encoder 371 of the roll drive motor 37, an encoder 162 of a cutter motor 161, and an encoder 388 of a displacing unit drive motor 387.

Based on the instruction from the main controller 410, the conveyance controller 420 conveys the sheet S by driving the roll drive motor 37 and the conveying motor 393, and cuts the sheet S by driving the cutter motor 161. The conveyance controller 420 also controls driving of the suction fan 17. Furthermore, the conveyance controller 420 performs processing (to be described later) for attaching the roll body R, by controlling driving of the displacing unit drive motor 387.

The image formation controller 430 prints an image on the sheet S based on the instruction from the main controller 410. More specifically, the image formation controller 430 prints an image on the sheet S by controlling driving of a carriage motor 121 and discharging of ink from the printhead 13. For example, when receiving a print job execution instruction and print data from a host computer or the like via the communication I/F of the control unit 400, the image formation controller 430 prints an image on the sheet S based on the print data.

Note that the abovementioned control configuration can be changed as needed. For example, the conveyance controller 420 and the image formation controller 430 can also perform control by receiving signals from the encoders of the individual motors and other sensors. Note also that one control unit 400 controls the individual elements of the printing apparatus A in the above example, but two or more control units may also share the processes to be executed by the printing apparatus A.

<Explanation of Details of Sheet Feeding Unit>

Each component of the sheet feeding unit 3 will be explained below with reference to FIG. 2 again. In this embodiment, the sheet feeding unit 3 includes an upper guide 32, a roll cover 33, a roller unit 34, and a displacing unit 38, in addition to the components explained in <Outline of Sheet Feeding Unit>.

The supporting unit 36 rotatably supports the roll body R on which the sheet S is wound. The supporting unit 36 includes a spool 361 that is inserted into a hollow portion of the cylindrical roll body R and supports the roll body R, and a holding unit 362 for rotatably holding the spool 361. The spool 361 has a spool gear (not shown) in one end portion. In addition, a spool holder (not shown) is attached to the two ends of the spool 361, and the spool 361 is rotatably supported by the holding unit 362 via this spool holder. That is, the spool holder functions as a bearing existing between the spool 361 and the holding unit 362.

The roll drive motor 37 feeds the sheet S by rotating the roll body R supported by the supporting unit 36. The roll drive motor 37 transmits the driving force to the spool gear of the spool 361 via a drive gear (not shown), thereby rotating the spool 361. This rotates the roll body R supported by the spool 361. Note that in the following explanation, the rotating direction of the roll body R when the sheet S is fed in the conveying direction will be referred to as a forward direction or a feed direction, and the rotating direction opposite to that will be referred to as a reverse direction or a take-up direction.

The lower guide 31 is a conveying path forming member that is installed in a position spaced apart from the roll body R supported by the supporting unit 36, and forms the conveying path P1 of the sheet S. The sheet S fed from the roll body R by the roll drive motor 37 passes through the conveying path P1 and enters the printing unit 1.

The upper guide 32 is so formed as to cover the conveying path P1 above the lower guide 31. That is, the upper guide 32 is a cover member for protecting the sheet S being conveyed. From another viewpoint, the upper guide 32 is a conveying path forming member for forming the conveying path P1.

The conveying unit 39 conveys the sheet S fed from the roll body R to the printing unit 1 on the downstream side in the conveying direction. In this embodiment, the conveying unit 39 includes a conveying roller 391 to be driven by the conveying motor 393, and a driven roller 392 to be driven by the conveying roller 391.

An end portion S1 of the sheet S is pulled out from the roll body R held by the holding unit 362, by a sequence (to be described later), a user's manual operation, or the like, and fed to the downstream side through a sheet conveying path along the lower guide 31 and the upper guide 32. In this embodiment, the end portion S1 is the leading edge of the sheet S in the conveying direction of the sheet S. When the end portion S1 reaches a nip portion between the conveying roller 391 and the driven roller 392, the conveying motor 393 rotates the conveying roller 391, and the end portion S1 is sandwiched between the conveying roller 391 and the driven roller 392. When the conveying roller 391 is further rotated in this state, the end portion S1 is conveyed onto the platen 11 that opposes the printhead 13.

The roll cover 33 covers the roll body R supported by the supporting unit 36. The roll cover 33 protects the roll body R against adhesion of dust, and prevents a printed image from being disturbed by preventing the user from touching the roll body R during printing. The roll cover 33 has a structure in which a member having an arc-like sectional shape extends in the widthwise direction (X direction) of the roll body R, and protects the roll body R by covering the roll body R inside the arc.

Figure 4A:
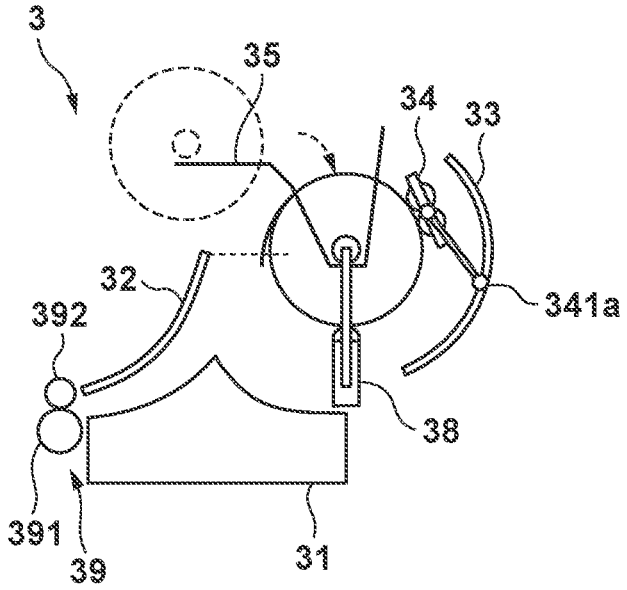
FIG. 4A is a side view schematically showing the sheet feeding unit.
Figure 4B:
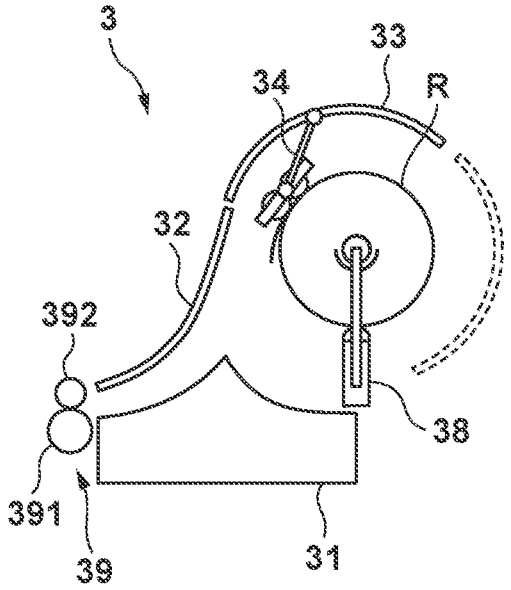
FIG. 4B is a side view schematically showing the sheet feeding unit.

FIG. 4A is a side view schematically showing the sheet feeding unit 3 when the roll cover 33 is open. FIG. 4B is a side view schematically showing the sheet feeding unit 3 when the roll cover 33 is closed. Note that FIGS. 4A and 4B do not show some components. The roll cover 33 is so formed as to be openable/closable with respect to the housing 7. The roll cover 33 covers the roll body R in the closed state, and makes the roll body R detachable from the supporting unit 36 in the open state. In this embodiment, the roll cover 33 is pivotably supported by the housing 7 at the two end portions in the widthwise direction of the roll body R, and the pivotal center is in almost the same position as the axial center of the spool 361. The roll cover 33 can pivot between an open position (FIG. 4A) that does not interfere with the moving locus of the roll body R when setting the roll body R in the supporting unit 36, and a closed position (FIG. 4B) in which the roll body R is fed or printing is performed. In addition, the roller unit 34 is attached to the inner surface of the arc shape of the roll cover.

Figure 5:
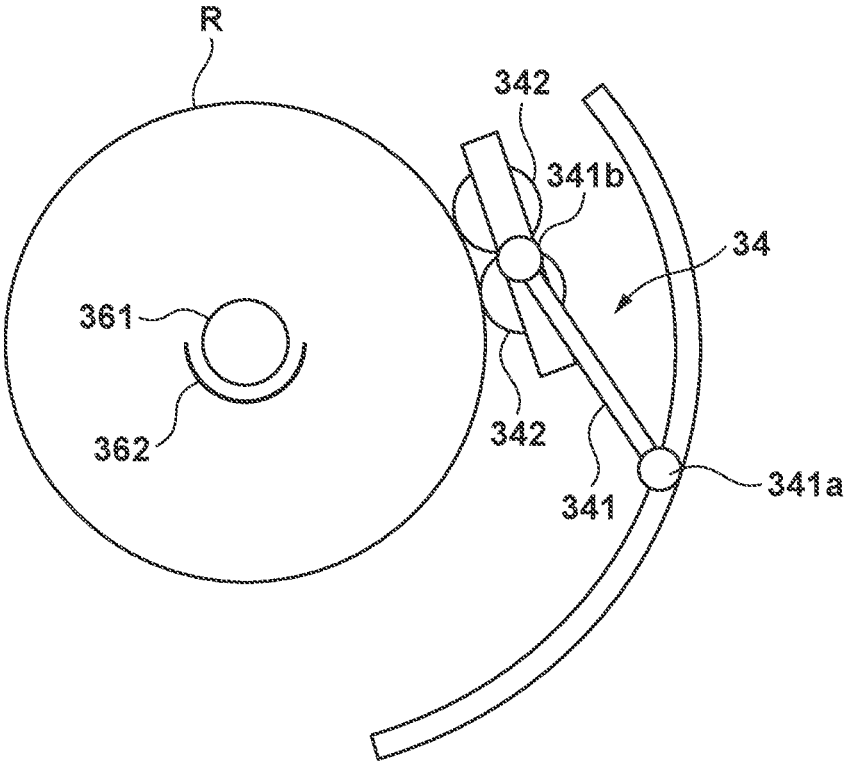
FIG. 5 is a view for explaining the arrangement of a roller unit.

FIG. 5 is a view for explaining the arrangement of the roller unit 34. The roller unit 34 includes a torsion coil spring (not shown), an arm 341, and two rollers 342. An end portion 341*a* of the arm 341 is rotatably connected to the inside of the arc-shaped portion of the roll cover 33. The two rollers 342 can rotate on their own axes, and can also rotate around an end portion 341*b* of the arm 341. The rotatable angles of the end portions 341*a* and 341*b* are set to be equal to or larger than at least an angle necessary to abut against rolls from a large roll to a small roll of the roll body R (to be described later). A torsion coil spring is formed in a connecting portion between the end portion 341*a* of the arm 341 and the roll cover 33, and the torsion coil spring biases the arm 341 in a direction in which the rollers 342 approach the axial center of the roll body R. In this example shown in FIG. 5, the torsion coil spring biases the rollers 342 counterclockwise around the end portion 341*a* as a rotational axis.

Next, the operation of the roller unit 34 when the roll body R is attached to the supporting unit 36 will be explained. When the roll body R rolls on the slope of a setting table 35 and is set in the supporting unit 36 (FIG. 4A), the outer circumferential surface of the roll body R comes in contact with one of the rollers 342. Then, the two rollers 342 rotate around end portions B as pivotal centers, and are equalized to an angle at which both of the two conveying nip rollers come in contact with the outer circumference of the roll body R. In this state, the roll body R pushes the arm 341, and the spring force of the torsion coil spring of the end portion 341*a* presses the outer surface of the roll body R. In this state, the positions and angles of the arm 341 and the rollers 342 when the roll body R is set change in accordance with the outer diameter of the roll body R. When the roll cover 33 is in the closed position (FIG. 4B), however, the tangent between the outer diameter of the roll body R and the rollers 342 points in the direction of the conveying path P1 if the outer diameter of the roll body R is a minimum roll diameter Dmin to a maximum roll diameter Dmax as usable diameters.

Figure 6A:
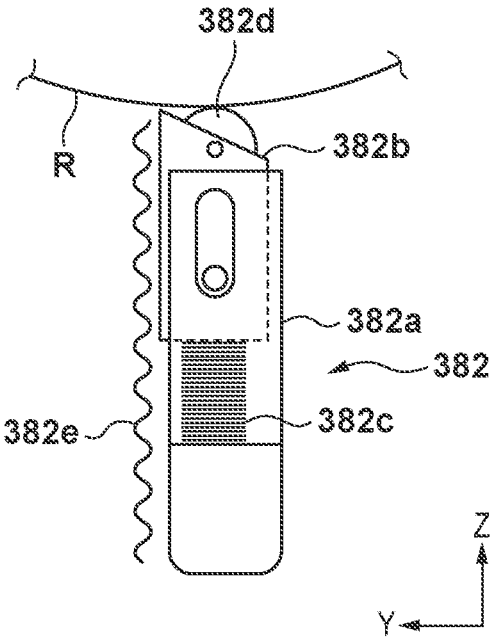
FIG. 6A is a view for explaining the arrangement of a displacing unit.
Figure 6B:
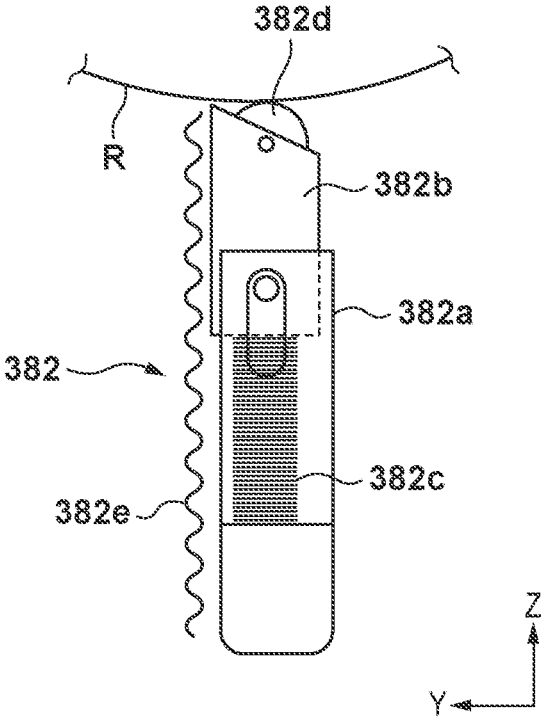
FIG. 6B is a view for explaining the arrangement of the displacing unit.
Figure 8:
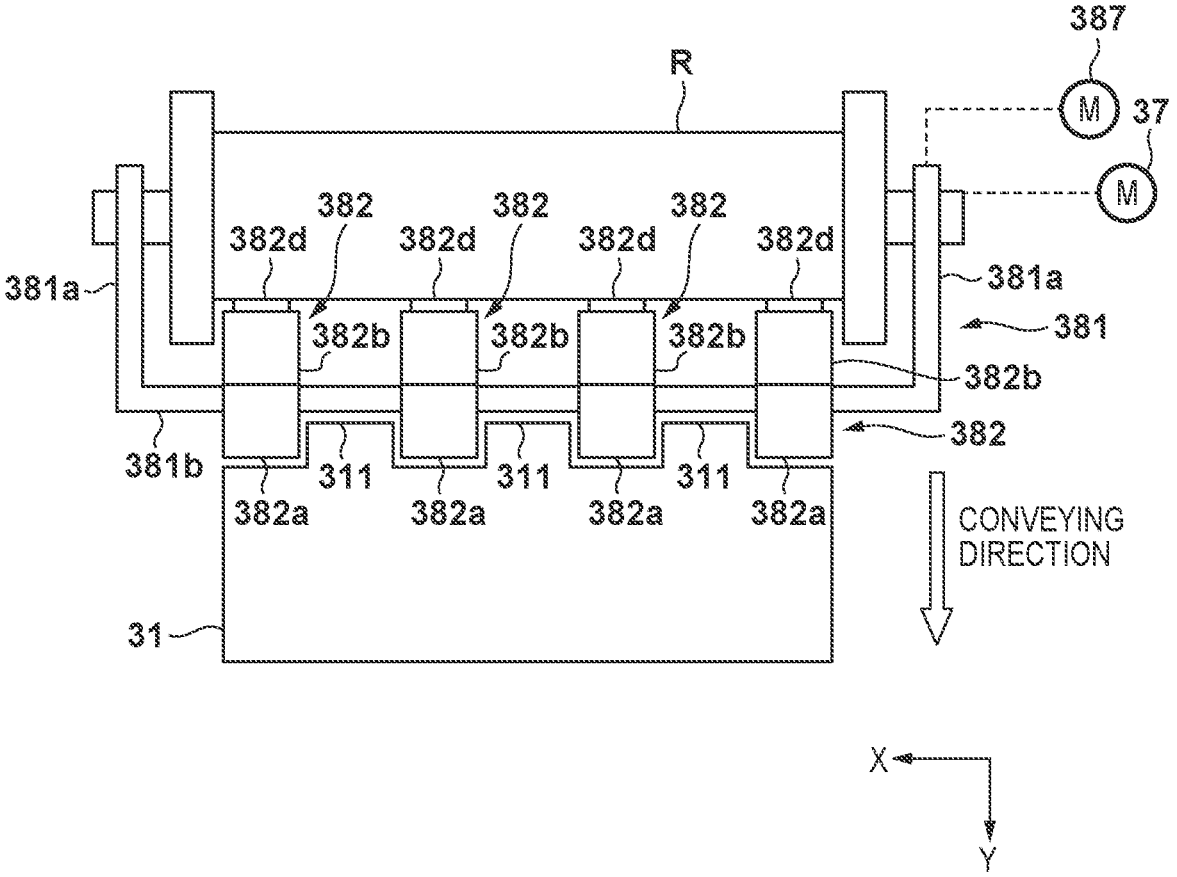
FIG. 8 is a plan view schematically showing the sheet feeding unit.

The arrangement of the displacing unit 38 will be explained below with reference to FIGS. 2, 6A, 6B, and 8. FIGS. 6A and 6B are views for explaining the arrangement of the displaying unit 38. That is, FIG. 6A is a view showing a state in which the roll body R having a large roll diameter is set, and FIG. 6B is a view showing a state in which the roll body R having a small roll diameter is set. FIG. 8 is a plan view schematically showing the sheet feeding unit 3.

The displacing unit 38 guides the end portion S1 of the sheet S separated from the roll body R to the conveying path P1. In this embodiment, the displacing unit 38 can move the outer circumference of the roll body R around the rotational center of the roll body R as a fulcrum. The displacing unit 38 includes a pivoting portion 381 and a guide portion 382.

The pivoting portion 381 is a member that supports the guide portion 382 and can pivot around the rotational axis of the roll body R. The pivoting portion 381 includes side members 381*a* extending from the two outside positions of the roll body R to the outside in the radial direction of the roll body R on the rotational axis of the roll body R and in the widthwise direction. The pivoting portion 381 also includes a transverse member 381*b* that extends over the widthwise direction of the roll body R, and connects the end portions of the side members 381*a* on the side opposite to the rotational axis side of the roll body R. The side members 381*a* are rotatably supported by the housing 7 on the outside of the holding unit 362 for holding the spool 361, and pivoted by the driving force of the displacing unit drive motor 387. The transverse member 381*b* includes a plurality of guide portions 382 spaced apart from each other in the widthwise direction intersecting the conveying direction of the roll body R.

Figure 7A:
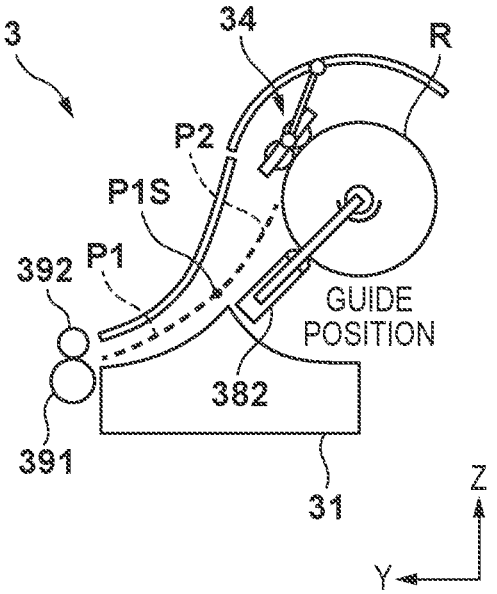
FIG. 7A is a view for explaining the stop position of a guide portion.
Figure 7B:
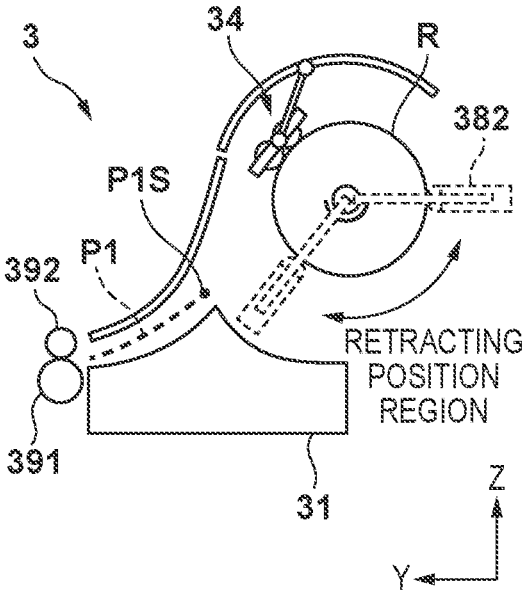
FIG. 7B is a view for explaining the stop position of the guide portion.

The guide portions 382 guide the sheet S to the conveying path P1 by being displaced by the pivotal motion of the pivoting portion 381. FIGS. 7A and 7B are views for explaining the stop position of the guide portion 382. The guide portion 382 can be displaced between a guide position (FIG. 7A) on the side of a start position P1S of the conveying path P1 and a retracting position (FIG. 7B) farther from the start position P1S than the guide position. Note that the retracting position can be set as needed in a retracting position region shown in FIG. 7B.

The guide portion 382 includes a flexible portion 382*b*, a fixed portion 382*a*, a spring 382*c*, and a distal end roller 382*d*.

The fixed portion 382*a* is connected to the transverse member 381*b* of the pivoting portion 381. The spring 382*c* is connected to the fixed portion 382*a* on the outside in the radial direction of the roll body R, and connected to the flexible portion 382*b* on the inside in the radial direction. Note that it is also possible to use a flexible member such as an elastic member instead of the spring 382*c*.

The flexible portion 382*b* is connected to the fixed portion 382*a* via the spring 382*c*. When the spring 382*c* expands or contracts, the flexible portion 382*b* can reciprocate in the radial direction of the roll body R with respect to the fixed portion 382*a*. From another viewpoint, the whole shape of the guide portion 382 can expand and contract in the radial direction of the roll body R. Also, the flexible portion 382*b* rotatably supports the distal end roller 382*d* on the side of the roll body R. Note that the distal end shape of the flexible portion 382*b* on the side of the roll body R extends toward the roll body R beyond the rotational axis of the distal end roller 382*d*, on the upstream side in the rotating direction when the roll body R is fed. By thus decreasing the gap between the outer surface of the roll body R and the distal end portion of the flexible portion 382*b*, it is possible to prevent the end portion S1 of the sheet S from entering the gap when, for example, the curling of the sheet S is strong.

The distal end roller 382*d* forms a contact portion that comes in contact with the outer surface of the roll body R. In this embodiment, it is possible to prevent scars and marks from remaining on the roll body R because the contact portion is the distal end roller 382*d*. In this embodiment, the distal end roller 382*d* presses the roll body R by expansion/contraction of the spring 382*c*. In other words, the spring 382*c* functions as a pressing portion that presses the distal end roller 382*d* toward the inside of the roll body R in the radial direction.

The guide portion 382 is expandable/contractable in the radial direction of the roll body R, and hence operates so as not to form any gap between the guide portion 382 and the roll body R even when the radius of the roll body R changes. More specifically, since the distance from the rotational axis of the roll body R to the fixed portion 382*a* is constant, the distance from the fixed portion 382*a* to the outer surface of the roll body R changes when the diameter of the roll body R is large (FIG. 6A) and when the diameter of the roll body R is small (FIG. 6B). However, the spring 382*c* makes the flexible portion 382*b* movable in the radial direction of the roll body R with respect to the fixed portion 382*a*, so the biasing force of the spring 382*c* holds the state in which the distal end roller 382*d* is in contact with the outer surface of the roll body R. With this arrangement, it is possible to prevent the end portion S1 of the roll body R from entering the gap between the outer surface of the roll body R and the guide portion 382 due to the curling or the like when performing processing to be described later.

As shown in FIG. 2, the guide portion 382 in the guide position forms a conveying path P2 between the conveying path P1 and the roll body R. That is, the guide portion 382 also functions as a conveying path forming member for forming the conveying path of the sheet S. In other words, the guide portion 382 is a variable guide portion for guiding the sheet S. In this embodiment, the +Y-side surface of the fixed portion 382*a* and the flexible portion 382*b* is a guide surface 382*e* forming the conveying path P2. Therefore, the path length of the conveying path P2 changes in accordance with expansion/contraction of the flexible portion 382*b*.

Next, the positional relationship between the guide portion 382 and the lower guide 31 will be explained with reference to FIG. 8. In this embodiment as described above, the plurality of a guide portions 382 are formed as they are spaced apart from each other in the widthwise direction of the roll body R. The lower guide 31 has extended portions 311 extended between the plurality of guide portions 382 spaced apart from each other. In other words, between the plurality of guide portions 382, the lower guide 31 extends to the upstream side more than the downstream-side end portions of the guide portions 382 in the conveying direction of the sheet S. Thus, the portion of the lower guide 31 on the upstream side in the conveying direction has a comb tooth shape, and the plurality of guide portions 382 enter portions between the comb teeth. This makes it possible to prevent the end portion S1 of the sheet S from entering these gaps between the teeth. Consequently, the occurrence of a sheet feed error or the like can be prevented.

<Explanation of Operation of Sheet Feeding Unit>

Figure 9:
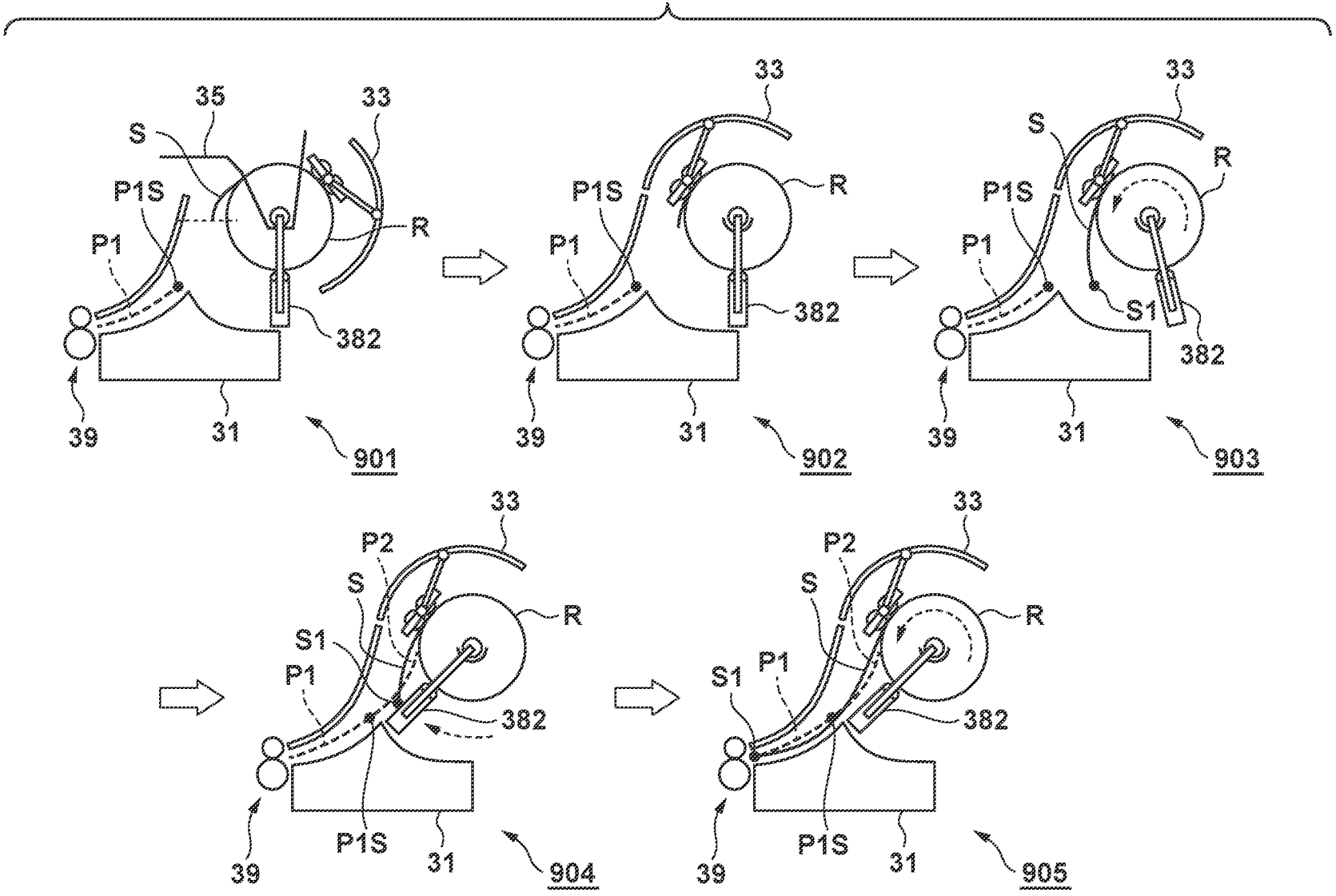
FIG. 9 is a schematic view for explaining the operation of the sheet feeding unit.

The operation of the sheet feeding unit 3 will be explained with reference to FIG. 9. FIG. 9 is a schematic view for explaining the operation of the sheet feeding unit 3. More specifically, the operation shown in FIG. 9 is a sheet feeding operation of guiding the end portion S1 of the sheet S to the conveying path P1 when the roll body R is attached to the supporting unit 36. In this embodiment, the sheet feeding operation is performed from a state in which the user has set the leading edge of the roll body R in a designated position.

First, the user manually pivots the roll cover 33 to the open position in order to set the roll body R. In this state, the printing apparatus A is in a standby state (including a power OFF state or a sleep state), and the displacing unit 38 is hanging down in the vertical direction due to its own weight and hence is in a position that does not interfere with the locus of the roll body R when the roll body R is set. When the user sets the spool 361 on the slope of the setting table 35 with the roll body R being attached to the spool 361 and releases the spool 361, the spool 361 goes down on the slope by the influence of gravity, rides on the holding unit 362 having the arc-shaped surface, and is supported (state 901). In this state, the spool gear of the spool 361 is connected to the roll drive motor 37 via the driving gear on the side of the printing apparatus A.

After that, the user removes a slack caused by loosening of the roll body R or the like, sets the end portion S1 of the roll body R in the set position, and pivots the roll cover 33 to the closed position (state 902). Thus, the setting of the roll body R is complete.

When the operation panel 6 accepts the execution of a "sheet feeding mode" after that, the displacing unit 38 moves to a predetermined retracting position. More specifically, the displacing unit drive motor 387 drives under the control of the control unit 400, and the guide portion 382 of the displacing unit 38 moves to the retracting position. Then, the roll drive motor 37 rotates by a predetermined amount in the sheet feeding direction and stops (state 903). Note that in this embodiment, the "sheet feeding mode" is a mode in which the sheet S is fed to the printing unit 1 when the roll body R is set.

Since this rotation (conveyance) conveys the end portion S1 of the roll body R downward under the influence of gravity, a gap is formed between the end portion S1 of the roll body R and the outer surface of the roll body R inside the end portion S1. In other words, the end portion S1 as the leading edge of the sheet S is separated from the roll body R supported by the supporting unit 36. Furthermore, this rotation causes the end portion S1 of the sheet S to hang down from the roll body R. In this embodiment, the roll drive motor 37 rotates the roll body R so that the end portion S1 separated from the roll body R is positioned between the start position P1S of the conveying path P1 and the guide portion 382 in the retracting position.

In this state, the displacing unit 38 is displaced from the retracting position to the guide position (step 904), so the end portion S1 is scooped up by the guide portion 382 and guided to the start position P1S of the conveying path P1.

When the roll drive motor 37 rotates the roll body R in the forward direction after that, the sheet S is fed to the conveying roller 391 through the conveying path P2 formed by the guide portion 382 and the conveying path P1 formed by the lower guide 31 (state 905). Thus, the initial sheet feeding operation when the roll body R is set is complete.

Figure 10:
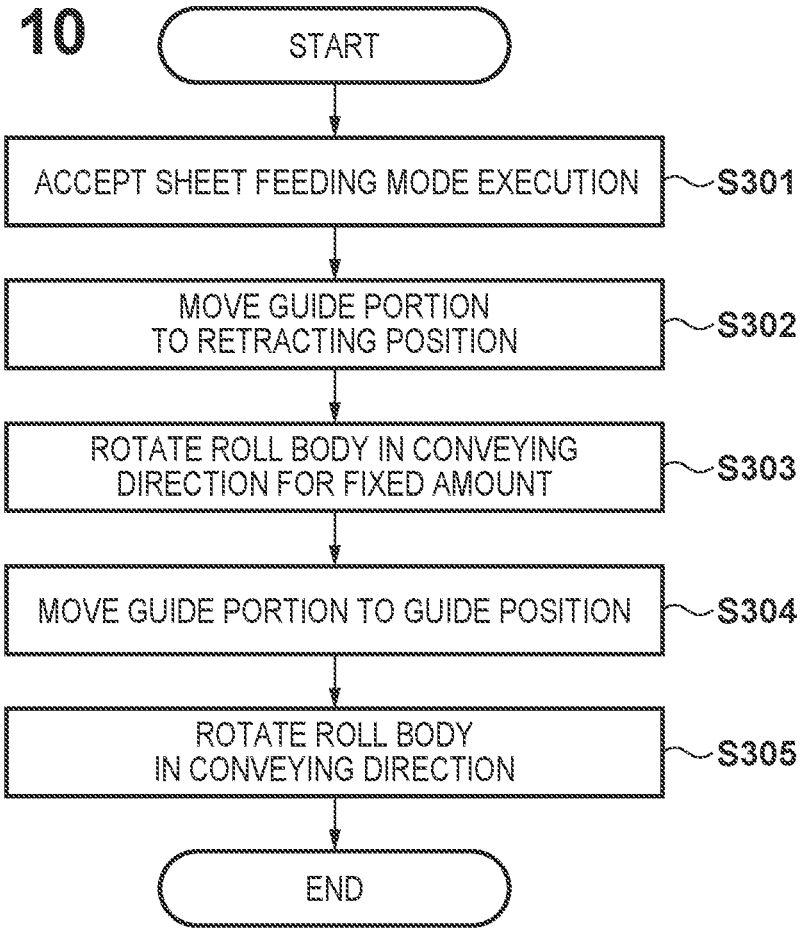
FIG. 10 is a flowchart showing an example of the processing of a control unit.

The processing of the control unit 400 when the printing apparatus A performs the abovementioned operation will be explained below. FIG. 10 is a flowchart showing an example of the processing of the control unit 400. For example, the control unit 400 starts this flowchart when the printing apparatus A returns from the standby state (including the power OFF state and the sleep state) after the user has set the roll body R in the standby state (state 902).

In step S301, the control unit 400 checks whether the operation panel 6 has accepted the execution of the "sheet feeding mode". The control unit 400 advances to step S302 if YES in step S301, and terminates the processing if not. Since the initial operation like acceptance of the "sheet feeding mode" is executed, the roll drive motor 37 is so controlled as to rotate the roll R in the following steps.

In step S302, the control unit 400 controls the displacing unit drive motor 387 to move the guide portion 382 to the retracting position from the state in which the guide portion 382 is hanging down by its own weight (state 902→state 903).

In step S303, the control unit 400 rotates the roll body R by a predetermined amount by controlling the roll drive motor 37 (state 902→state 903). In the embodiment, the predetermined amount is the rotation amount of the roll body R by which the end portion S1 of the sheet S separates from the roll body R and hangs down between the start position P1S of the conveying path P1 and the guide portion 382 in the retracting position. Note that the rotation amount required until the end portion S1 hangs down between the start position P1S and the guide portion 382 in the retracting position increases as the outer diameter of the attached roll body R decreases. Therefore, the predetermined amount may also be a rotation amount by which the end portion S1 of the sheet S of even a roll body R having a small outer diameter, among attachable roll bodies R, hangs down between the start position P1S and the guide portion 382 in the retracting position. In the embodiment, the predetermined amount can also be set such that the rotational angle of the roll body R is a predetermined angle from 1° to 180° when the leading edge of the sheet is set in the position of nine o'clock when viewed from the direction in the drawing. Note that the predetermined amount may also be a rotation amount by which the leading edge of the sheet is positioned on the guide portion 382 when the guide portion 382 moves to the guide position.

In step S304, the control unit 400 moves the guide portion 382 to the guide position by controlling the displacing unit drive motor 387 (state 903→state 904). Consequently, the end portion S1 of the sheet S is scooped up by the guide portion 382 and guided to the start position P1S of the conveying path P1.

In step S305, the control unit 400 rotates the roll body R forward (state 904→state 905). As a result, the sheet S advances to the conveying path P1 and the printing unit 1 on the downstream side.

In this embodiment as explained above, the guide portion 382 of the displacing unit 38 is displaced from the retracting position to the guide position when the end portion S1 as the leading edge of the sheet S separated from the roll body R is positioned between the start position P1S and the guide portion 382 in the retracting position. Then, the end portion S1 is guided to the start position P1S. Since, therefore, the end portion S1 of the sheet S is guided to the start position P1S of the conveying path P1 in the state in which the end portion S1 is separated from the roll body R, it is possible to guide the rolled sheet S to the conveying path P1 more reliably.

Note that in this embodiment, after the roll body R is rotated by the predetermined amount (step S303) so that the end portion S1 of the sheet S hangs down, the guide portion 382 is displaced to the guide position (step S304). However, it is also possible to simultaneously perform at least some of these operations. In this case, the roll drive motor 37 and the displacing unit drive motor 387 can also be controlled such that the end portion S1 hangs down between the start position P1S and the guide portion 382 before the guide portion 382 reaches the guide position.

Second Embodiment

A sheet feeding unit 8 according to the second embodiment will be explained with reference to FIGS. 12 and 13. Note that in the following explanation, the same reference numerals as in the first embodiment denote similar components, and an explanation thereof will be omitted.

In the first embodiment, an end portion S1 separates from a roll body R and hangs down when a roll drive motor 37 rotates the roll body R by a predetermined amount. However, if, for example, the position of a leading edge S of the roll body R set by the user is shifted, the end portion S1 does not hang down between a start position P1S and a guide portion 382 in a retracting position in some cases depending on the set position. If this is the case, it is sometimes impossible to scoop up the end portion S1 by the guide portion 382 and guide the sheet S to a conveying path P1.

In this embodiment, therefore, the sheet feeding unit 8 has a sensor 301 capable of detecting the end portion S1 in a predetermined position between a guide position and a retracting position. In this embodiment, the sensor 301 is attached to a lower guide 31 and capable of detecting the leading edge of the roll body R, which hangs down due to the rotation of the roll drive motor 37 in a predetermined position on the side of the −Y direction.

Since the guide portion 382 is displaced after the end portion S1 is detected by the sensor 301, the guide portion 382 scoops up the end portion S1 more reliably, and guides the end portion S1 to the start position P1S of the conveying path P1. Note that it is possible to use a light reflective photosensor, an ultrasonic sensor, or the like as the sensor 301.

Figure 12:
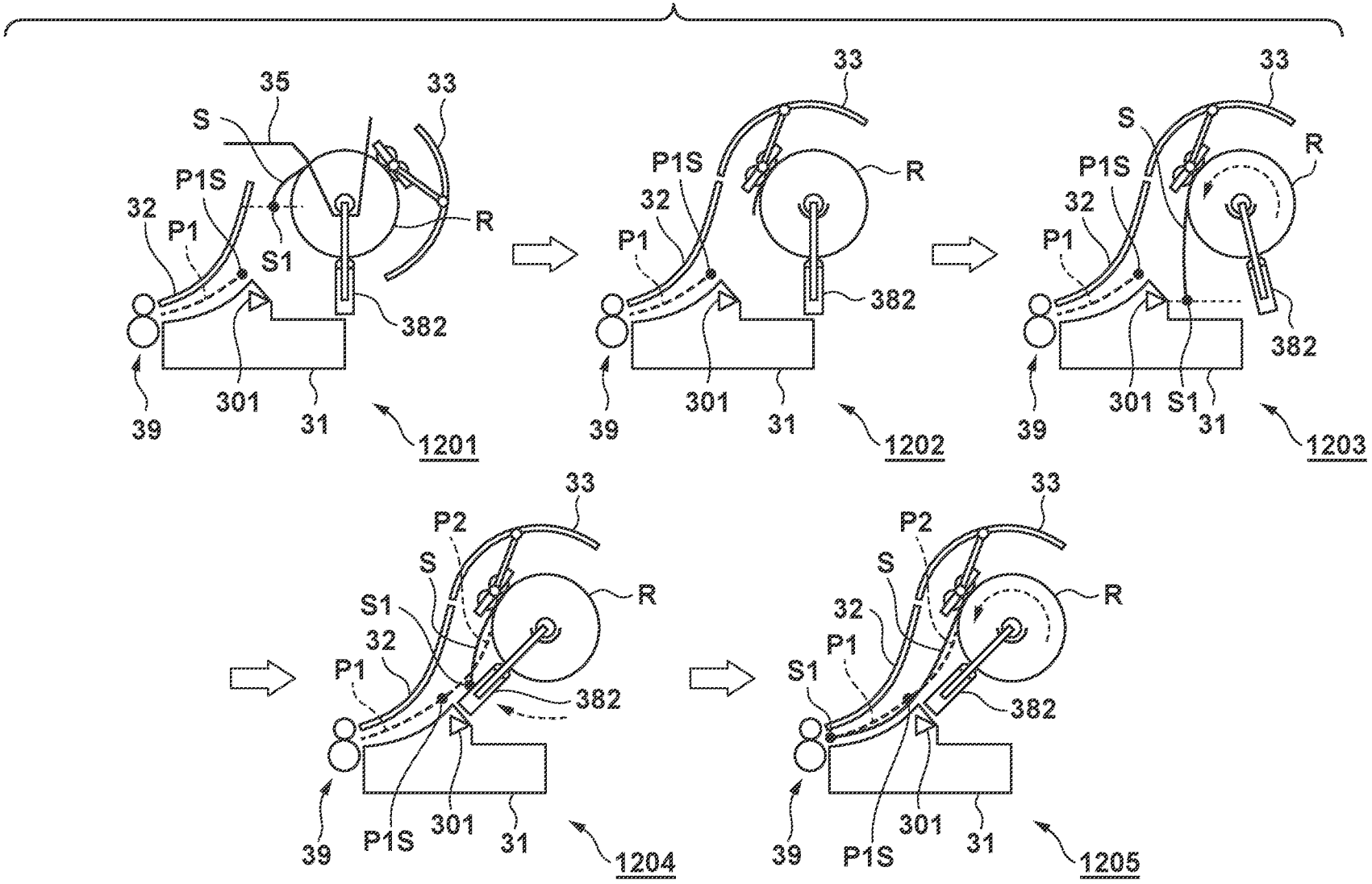
FIG. 12 is a schematic view for explaining the operation of the sheet feeding unit.

FIG. 12 is a schematic view for explaining the sheet feeding operation of the sheet feeding unit 8 according to the embodiment. In this operation shown in FIG. 12, states 1201 and 1202 are respectively the same as states 901 and 902 shown in FIG. 9.

After that, the guide portion 382 retracts to the retracting position, and the roll drive motor 37 rotates the roll body R in the sheet feeding direction. The roll drive motor 37 stops rotating the roll body R when the sensor 301 detects the end portion S1 of the sheet S (state 1203). Operations until states 1204 and 1205 are the same as the operations until states 904 and 905 shown in FIG. 9.

Figure 13:
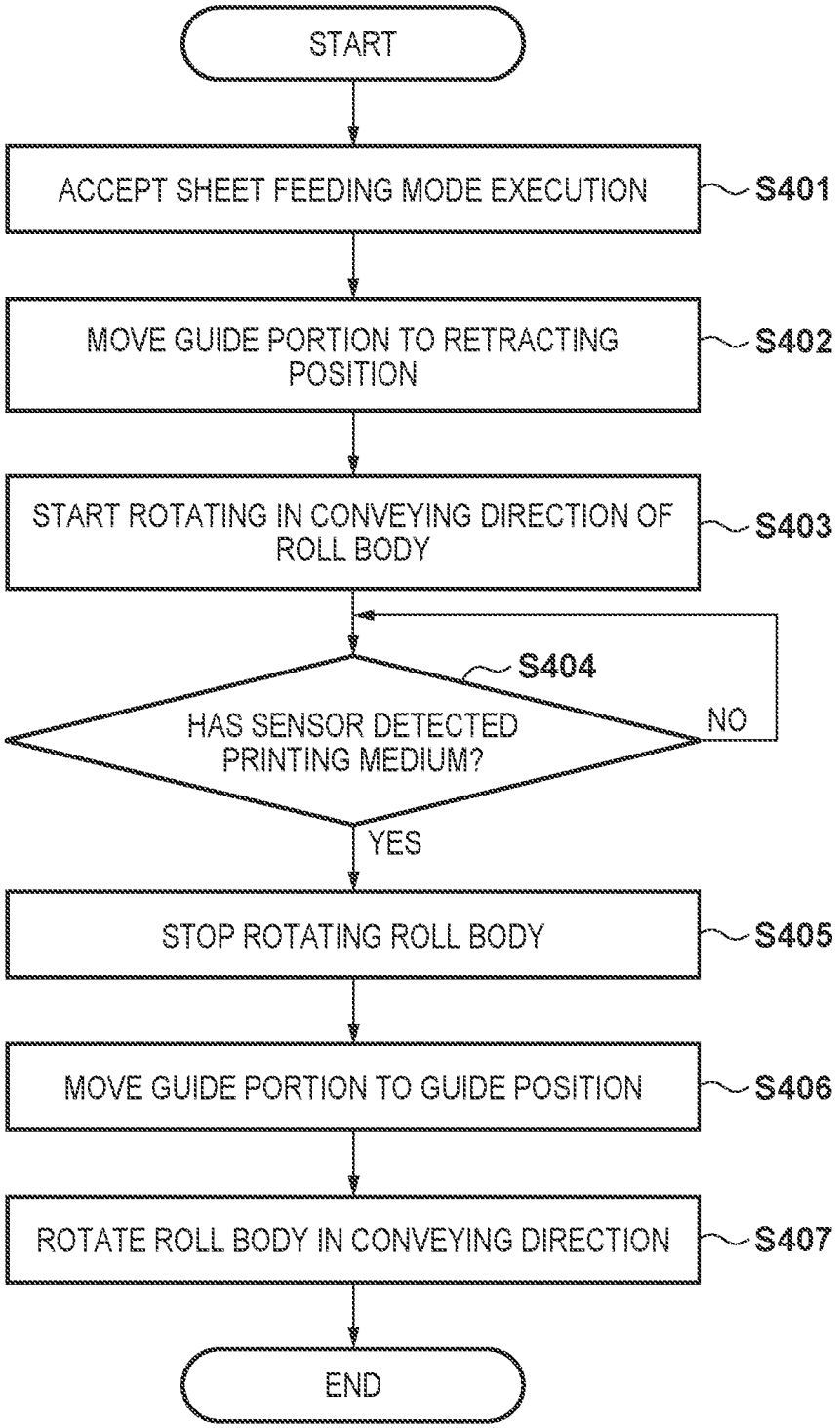
FIG. 13 is a flowchart showing an example of the processing of the control unit.

FIG. 13 is a flowchart showing an example of the processing of a control unit 400 when the sheet feeding unit 8 performs the operations shown in FIG. 12. Steps S401 and S402 (state 1202) are respectively the same as steps S301 and S302 shown in FIG. 10.

In step S403, the control unit 400 starts rotating the roll body R by controlling the roll drive motor 37.

In step S404, if the control unit 400 determines, based on an output value P301 from the sensor 301, that the sensor 301 has detected the end portion S1 of the sheet S, the process advances to step S405. If the control unit 400 determines that the sensor 301 has not detected the end portion S1, the control unit 400 repeats step S404.

As an example, when the output value P301 from the sensor 301 is set to increase as the distance to a detection target shortens, a low value P11 is output until the end portion S1 reaches a detection position D1 of the sensor 301. On the other hand, if the end portion S1 has reached the detection position D1 of the sensor 301, the distance between the sensor 301 and the detection target shortens, so the sensor 301 outputs a high value Ph1. Accordingly, the control unit 400 can determine that the sensor 301 has detected the end portion S1 of the sheet S if the output value P301 exceeds a predetermined threshold.

In step S405, the control unit 400 stops the rotation of the roll body R performed by the roll drive motor 37. That is, in steps S404 and S405, the roll drive motor 37 stops if the sensor 301 detects the end portion S1 of the sheet S.

Steps S406 and S407 are respectively the same as steps S304 and S305.

In this embodiment as explained above, when hanging down the end portion S1 of the sheet S, the drive motor 37 stops if the sensor 301 detects the end portion S1 of the sheet S. Accordingly, the end portion S1 can be guided to the start position P1S of the conveying path P1 regardless of variations in the initial position of the end portion S1, that is, the position set by the user.

Third Embodiment

A sheet feeding unit 9 according to the third embodiment will be explained with reference to FIGS. 14 to 17. In the following explanation, the same reference numerals as in the first and second embodiments denote similar components, and an explanation thereof will be omitted.

In the first and second embodiments as described above, the user must set an end portion S1 of a sheet S in a predetermined set position when setting a roll body R. In this embodiment, therefore, a configuration example in a case in which the user need not set the end portion S1 will be explained.

Figure 14:
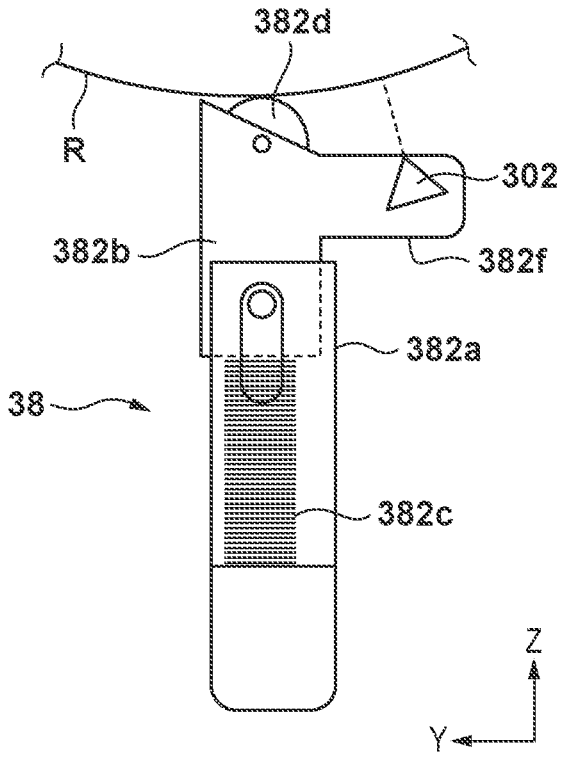
FIG. 14 is a schematic view showing the arrangement of the displacing unit and its periphery.

FIG. 14 is a schematic view showing the peripheral arrangement of a displacing unit 38 according to the embodiment. In this embodiment, the sheet feeding unit 9 has a sensor 302 capable detecting that the sheet S is separated from the roll body R in a predetermined position on the downstream side (the −Y side) of a guide portion 382 of the displacing unit 38 in the rotating direction when feeding the roll body R.

In this embodiment, a flexible portion 382*b* has a portion 382*f* extending to the −Y side from a portion for supporting a distal end roller 382*d*, and the sensor 302 is installed in the portion 382*f*. Therefore, the sensor 302 can perform sensing while holding a predetermined distance from the outer surface of the roll body R. It is possible to use a light reflective photosensor, an ultrasonic sensor, or the like as the sensor 302. As the sensor 302, it is also possible to use a sensor capable of obtaining an output value corresponding to the distance to a detection target.

Figure 15A:
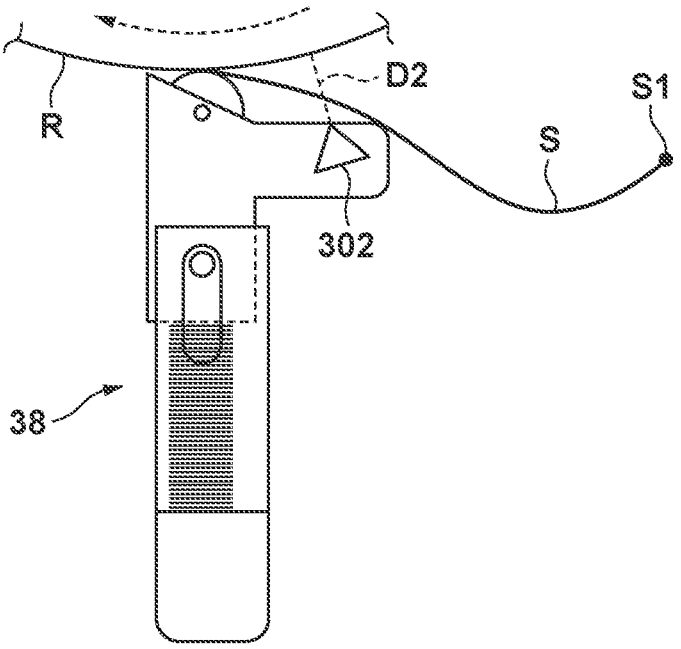
FIG. 15A is a side view schematically showing a sensor and the state of a printing medium to be detected by the sensor.
Figure 15B:
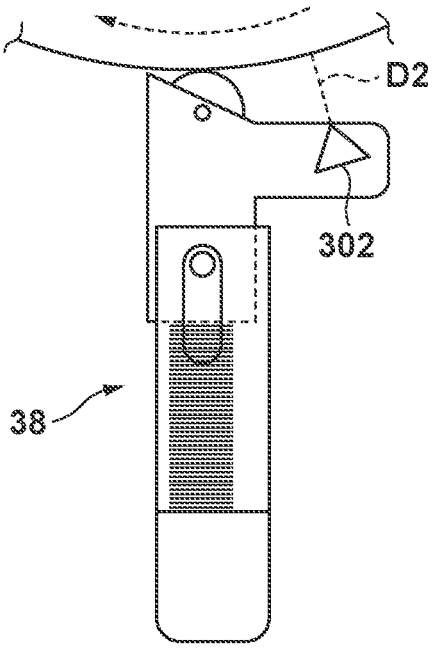
FIG. 15B is a side view schematically showing the sensor and the state of the printing medium to be detected by the sensor.

FIGS. 15A and 15B are side views schematically showing the sensor 302 and the state of the sheet S to be detected by the sensor 302. In this embodiment, the distance between the sensor 302 and the outer surface of the roll body R is held at a predetermined distance. Therefore, if the sensor 302 is so designed as to output a higher output value P302 as the distance to a detection target becomes shorter, the output value P302 from the sensor 302 is an almost constant output value P12 when the sheet S is not separated from the outer surface of the roll body R in a detection position D2 (FIG. 15B). On the other hand, when the sheet S is separated from the outer surface of the roll body R in the detection position D2, the output value P302 from the sensor 302 is an output value Ph2 larger than the output value P12 and corresponding to the distance between the sensor 302 and the sheet S (FIG. 15A). Accordingly, a control unit 400 can check whether the sheet S is separated from the outer surface of the roll body R in the detection position D2, based on whether, for example, the output value P302 from the sensor 302 is smaller than a threshold.

Figure 16:
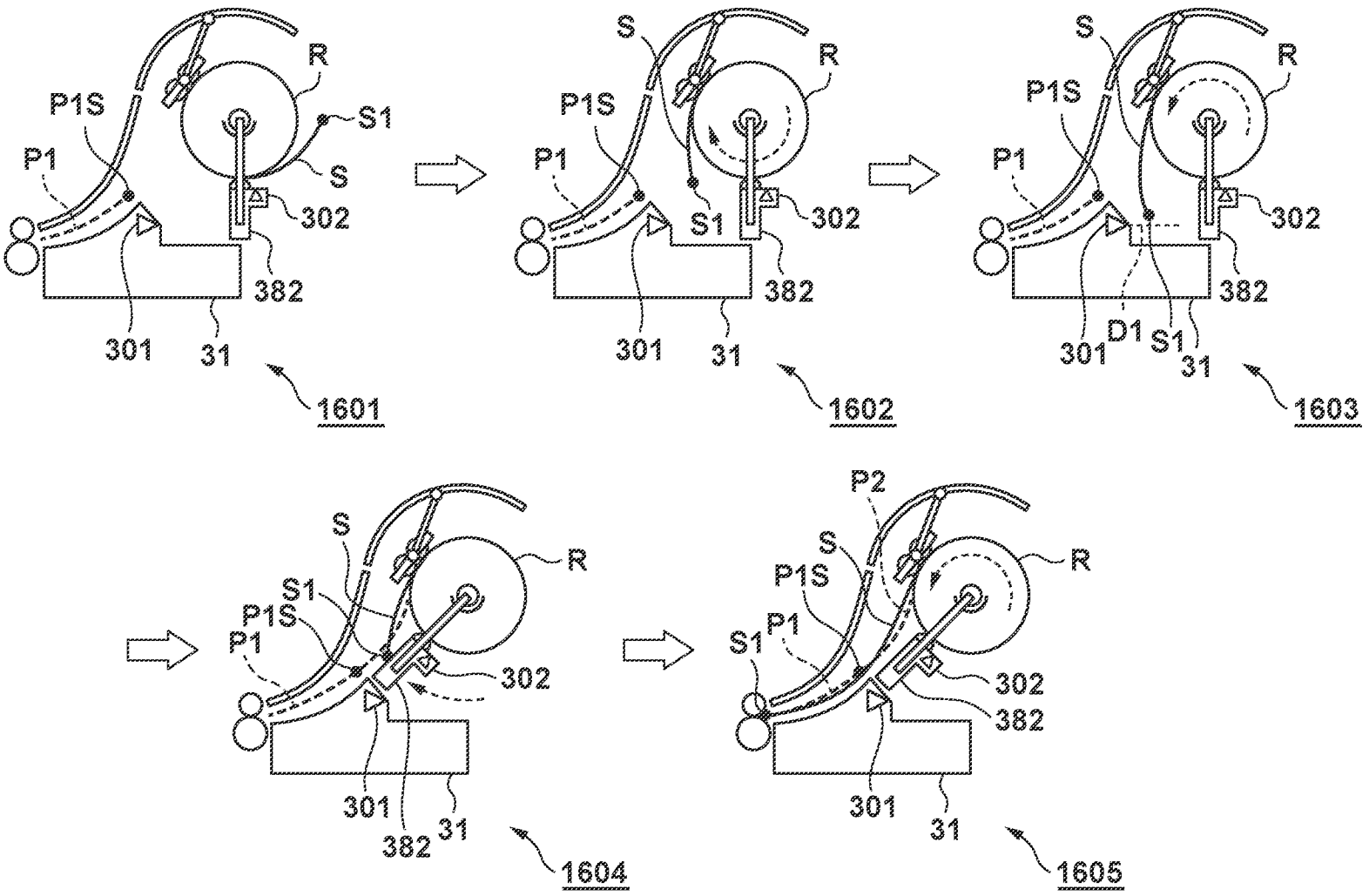
FIG. 16 is a schematic view for explaining the operation of the sheet feeding unit.

FIG. 16 is a schematic view for explaining the sheet feeding operation of the sheet feeding unit 9 according to the embodiment. More specifically, FIG. 16 shows an operation example when the user does not align the end portion S1 when setting the roll body R.

First, the user opens a roll cover 33, sets the roll body R in a supporting unit 36, and closes the roll cover 33 (state 1601). Then, when the user executes a "sheet feeding mode" from an operation panel 6, a roll drive motor 37 rotates the roll body R in a reverse direction (a take-up direction) based on the detection result of the sensor 302 (state 1602). For example, the roll drive motor 37 rotates the roll body R in the reverse direction by a predetermined amount since the sensor 302 does not detect that the sheet S is separated from the outer surface of the roll body R any longer. Accordingly, even if the user does not align the position of the end portion S1 when setting the roll body R, the end portion S1 moves to the upstream side of the guide portion 382 in the rotating direction for sheet feeding. Operations until states 1603 to 1605 are obtained after that are respectively the same as the operations until states 1203 to 1205 shown in FIG. 12 are obtained.

Figure 17:
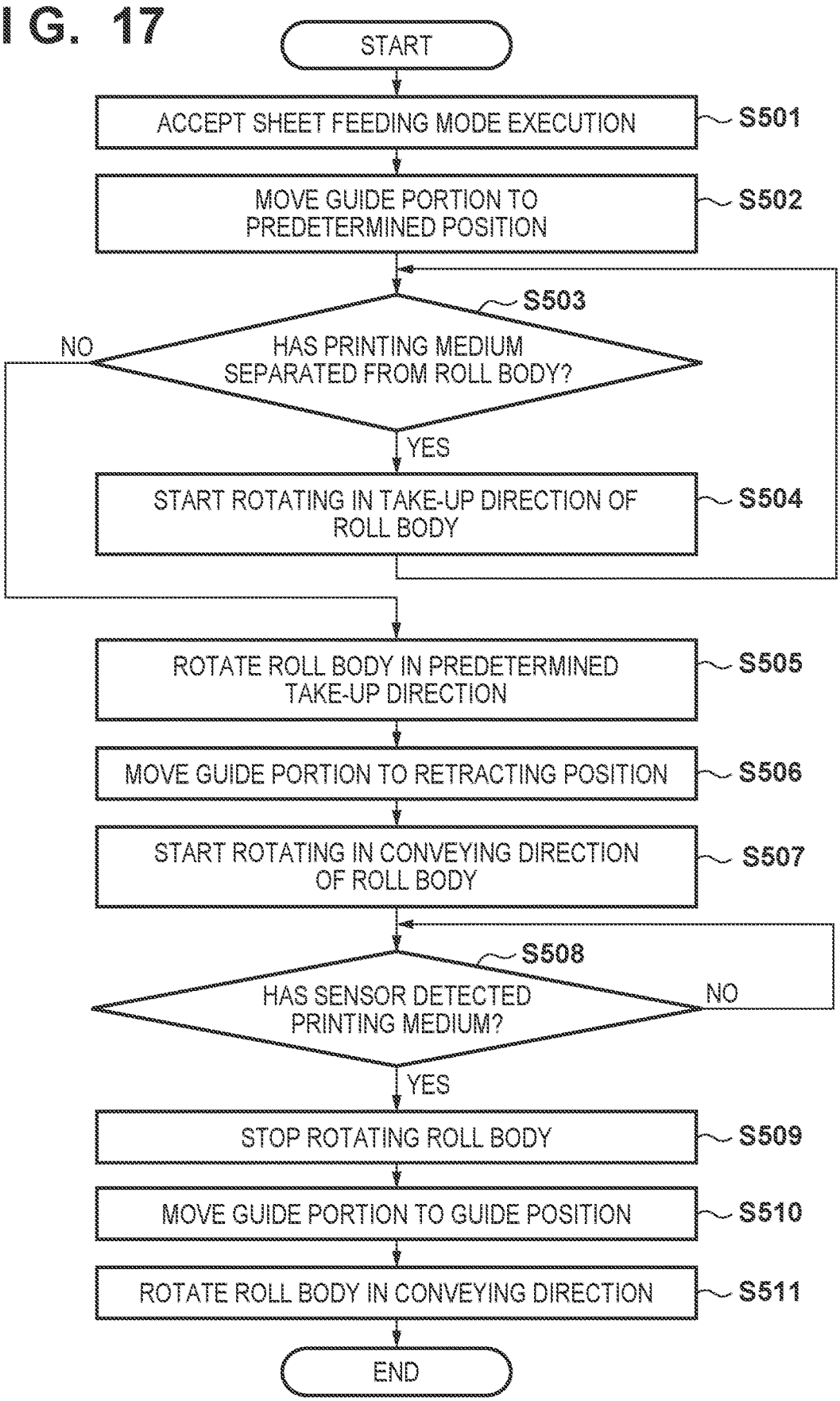
FIG. 17 is a flowchart showing an example of the processing of the control unit.

FIG. 17 is a flowchart showing an example of the processing of the control unit 400 when the sheet feeding unit 9 performs the operation shown in FIG. 16. Step S501 is the same as step S401.

In step S502, the control unit 400 moves the guide portion 382 to a predetermined position by controlling a displacing unit drive motor 387. The predetermined position can be, for example, a position below the rotational axis of the roll body R, so that the sensor 302 can easily detect the sheet S. Note that this step may also be omitted if the sheet feeding unit 9 is in the standby state before the execution of this flowchart and the guide portion is hanging down below the rotational axis of the roll body R.

In step S503, the control unit 400 checks whether the sheet S is separated from the roll body R in the detection position D2 of the sensor 302, based on the detection result from the sensor 302. The control unit 400 advances to step S504 if the sheet S is separated from the roll body R, and advances to step S505 if not. For example, the control unit 400 performs this check based on the output value P302 from the sensor 302.

In step S504, the control unit 400 starts rotating the roll body R in the take-up direction by controlling the displacing unit drive motor 387, and returns to step S503 after that. Note that this step may also be omitted if the displacing unit drive motor 387 has already started the rotation of the roll body R.

In step S505, the control unit 400 rotates the roll body R by a predetermined amount in the take-up direction by controlling the displacing unit drive motor 387. Consequently, the roll body R further rotates by the predetermined amount in the take-up direction even after the sensor 302 does not detect the sheet S separated from the roll body R any longer. Accordingly, the end portion S1 is positioned on the +Y side of the guide portion 382 more reliably.

Processes in steps S506 to S511 are the same as the processes in steps S402 to S407.

In this embodiment as explained above, the sheet S1 can be passed through the conveying path P1 without setting the end portion S1 of the roll body R in the designated position by the user. This makes it possible to improve the usability of the work for setting the roll body.

OTHER EMBODIMENTS

Figure 11A:
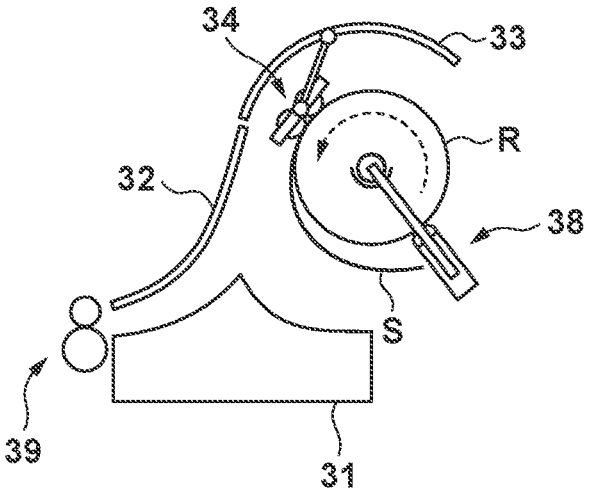
FIG. 11A is a view for explaining the setting of a retracting position corresponding to the type of a printing medium S.
Figure 11B:
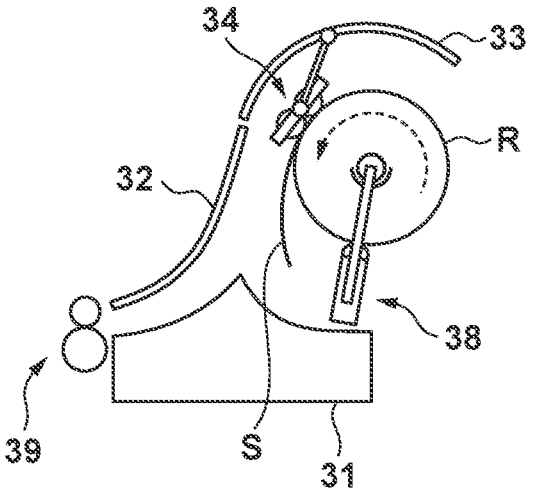
FIG. 11B is a view for explaining the setting of the retracting position corresponding to the type of the printing medium S.

It is also possible to adopt an arrangement in which the retracting position of the guide portion 382 can be changed in accordance with the type of the sheet S forming the roll body R to be set. FIGS. 11A and 11B are views for explaining the setting of the retracting position corresponding to the type of the sheet S.

Curling near the end portion S1 sometimes changes in accordance with the type of the sheet S forming the roll body R. For example, when the curling of the sheet S is strong, the end portion S1 is hardly separated from the outer surface of the roll body R even if the end portion S1 and its vicinity are subject to gravity. In a case like this, therefore, the retracting position of the displacing unit 38 is set on the −Y side of the vertical direction. This makes it possible to easily separate the end portion S1 and its vicinity from the outer surface of the roll body R under the influence of gravity (FIG. 11A).

On the other hand, when the curling of the sheet S is weak, the end portion S1 and its vicinity separate from the outer surface of the roll body R relatively easily. Accordingly, even if the retracting position of the displacing unit 38 is set on the +Y side of the vertical direction, the gap between the end portion S1 and the roll body R can sufficiently be secured (FIG. 11B). In addition, as for the throughput, when the retracting position is set on the +Y side closer to the guide position, the displacement amount of the guide portion 382 decreases, so the sheet S can be passed through the conveying path P1 within a short time. In the embodiment, the operation panel 6 can also accept the type of the sheet S input by the user. In this case, the control unit 400 can determine the retracting position of the guide portion 382 in accordance with the input type of the sheet S.

By thus changing the retracting position in accordance with the type of the sheet S, it is possible to pass the sheet S through the conveying path P1 more reliably and improve the throughput at the same time.

In the abovementioned embodiments, the end portion S1 hangs down from the roll body R (for example, state 903) when the roll drive motor 37 rotates the roll body R. However, the user can also manually pull out the sheet S from the roll body R. If the user pulls out a predetermined appropriate amount of the sheet S when attaching the roll body R, it is possible to obviate the need for the rotating operation of the roll drive motor 37, and shorten the time of the operation to be performed by the sheet feeding unit 3.

Figure 18:
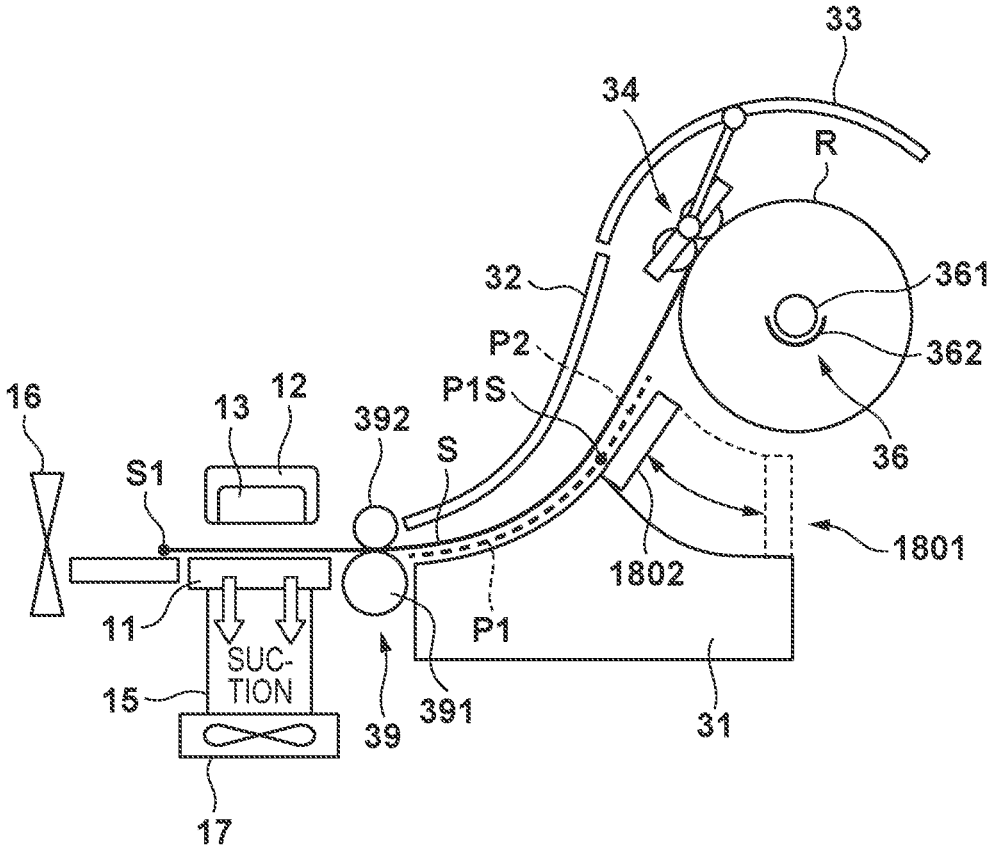
FIG. 18 is a schematic view showing a modification of the displacing unit.

Furthermore, in the above embodiments, the displacing unit 38 can pivot around the rotational axis of the roll body R. However, the mode of displacement of the displacing unit 38 is not limited to this. FIG. 18 is a schematic view showing a modification of the displacing unit. As shown in FIG. 18, a guide portion 1802 of a displacing unit 1801 can also reciprocate along the upper surface of the lower guide 31. For example, the guide portion 1802 may be movable on the lower guide 31 by an electric motor and a mechanism such as a rack and pinion. As another modification, the displacing unit can also pivot with respect to the lower guide 31.

The abovementioned embodiments have been explained by taking the printing apparatus A including the sheet feeding unit 3 (a sheet feeding apparatus) and the printing unit 1 as an example. However, the features of the above embodiments are also applicable to, for example, a sheet feeding apparatus separated from a printing unit (a printing apparatus) and connectable to another apparatus.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-017234, filed Feb. 4, 2020, which is hereby incorporated by reference herein in its entirety.

What is claimed is:

1. A sheet feeding apparatus comprising:

a supporting unit configured to rotatably support a roll sheet formed by winding a continuous sheet into a roll shape;

a conveying path through which a part of the sheet separated from the roll sheet supported by the supporting unit passes; and a displacing unit including a guide portion capable of being displaced between a guide position on the side of a start position of the conveying path, and a retracting position set farther from the start position than the guide position, wherein the guide portion includes a contact portion that comes in contact with an outer circumference of a cylindrical portion of the roll sheet supported by the supporting unit.

2. The apparatus according to claim 1, further comprising a driving unit configured to rotate the roll sheet supported by the supporting unit, thereby feeding the sheet, wherein the driving unit rotates the roll sheet such that a leading edge is separated from the roll sheet between the start position and the guide portion in the retracting position.

3. The apparatus according to claim 2, wherein when an initial operation is executed, the driving unit is controlled to rotate the roll sheet such that the leading edge is separated from the roll sheet between the start position and the guide portion in the retracting position.

4. The apparatus according to claim 2, further comprising a detecting unit configured to detect the sheet in a predetermined position between the guide position and the retracting position, wherein the driving unit stops rotating the roll sheet if the detecting unit detects the sheet.

5. The apparatus according to claim 2, further comprising a detecting unit configured to detect that the sheet is separated from the roll sheet at a predetermined position on a downstream side of the guide portion in a rotating direction when feeding the roll sheet, wherein the driving unit rotates the roll sheet in a direction opposite to the rotating direction of feeding if the detecting unit detects that the sheet is separated from the roll sheet.

6. The apparatus according to claim 1, wherein the guide portion includes a pressing portion configured to press the contact portion toward an inside of the roll sheet in a radial direction.

7. The apparatus according to claim 1, wherein the guide portion forms a second conveying path between the conveying path and the roll sheet when the guide portion is placed in the guide position.

8. The apparatus according to claim 7, wherein the guide portion includes a pressing portion configured to press the contact portion toward an inside of the roll sheet in a radial direction, the pressing portion is a spring, and the guide portion includes a fixed portion connected to the pivoting portion, and a flexible portion connected to the fixed portion via the spring and configured to support the contact portion such that the contact portion presses the roll sheet by expansion/contraction of the spring.

9. The apparatus according to claim 1, further comprising a driving unit configured to rotate the roll sheet supported by the supporting unit, thereby feeding the sheet, wherein the guide portion comprises a plurality of guide portions spaced apart from each other in a widthwise direction intersecting a feeding direction of the driving unit, and the conveying path extends between the plurality of guide portions spaced apart from each other.

10. The apparatus according to claim 1, wherein the retracting position can be changed in accordance with a type of the sheet.

11. A printing apparatus comprising:

a sheet feeding apparatus according to claim 1; and a printing unit configured to print an image on a sheet fed from the sheet feeding apparatus.

12. The apparatus according to claim 1, wherein the guide portion is displaced from the retracting position to the guide position when a leading edge of the sheet separated from the roll sheet supported by the supporting unit is positioned between the guide portion in the retracting position and the start position.

13. A sheet feeding apparatus comprising:

a supporting unit configured to rotatably support a roll sheet formed by winding a continuous sheet into a roll shape;

a conveying path through which a part of the sheet separated from the roll sheet supported by the supporting unit passes; and a displacing unit including a guide portion capable of being displaced between a guide position on the side of a start position of the conveying path, and a retracting position set farther from the start position than the guide position, wherein the displacing unit further includes a pivoting portion configured to support the guide portion and pivot around a rotational axis of the roll sheet.

14. The apparatus according to claim 13, further comprising a driving unit configured to rotate the roll sheet supported by the supporting unit, thereby feeding the sheet, wherein the driving unit rotates the roll sheet such that a leading edge of the sheet is separated from the roll sheet between the start position and the guide portion in the retracting position.

15. The apparatus according to claim 14, wherein when an initial operation is executed, the driving unit is controlled to rotate the roll sheet such that the leading edge is separated from the roll sheet between the start position and the guide portion in the retracting position.

16. The apparatus according to claim 14, further comprising a detecting unit configured to detect the sheet at a predetermined position between the guide position and the retracting position, wherein the driving unit stops rotating the roll sheet if the detecting unit detects the sheet.

17. The apparatus according to claim 14, further comprising a detecting unit configured to detect that a part of the sheet is separated from the roll sheet at a predetermined position on a downstream side of the guide portion in a rotating direction when feeding the roll sheet, wherein the driving unit rotates the roll sheet in a direction opposite to the rotating direction of feeding if the detecting unit detects that a part of the sheet is separated from the roll sheet.

18. The apparatus according to claim 13, wherein the retracting position can be changed in accordance with a type of the sheet.

19. A printing apparatus comprising:

a sheet feeding apparatus according to claim 13; and a printing unit configured to print an image on a sheet fed from the sheet feeding apparatus.

20. The apparatus according to claim 13, wherein the guide portion is displaced from the retracting position to the guide position when a leading edge of the sheet separated from the roll sheet supported by the supporting unit is positioned between the guide portion in the retracting position and the start position.

* * * * *